United States Patent [19]

Rossi et al.

[11] 4,376,626

[45] Mar. 15, 1983

[54] DEVICE FOR THE CONTROL OF A SEQUENTIAL BURNER OF A COOKING APPARATUS

[75] Inventors: Alphonse Rossi, Thionville Guentrange; Gérard Klammers, Thionville Garche, both of France

[73] Assignee: Etablissements Eugene Scholtes, Lagrange-Thionville, France

[21] Appl. No.: 195,511

[22] Filed: Oct. 9, 1980

[30] Foreign Application Priority Data

Oct. 9, 1979 [FR] France ..... 79 25055
Jan. 25, 1980 [FR] France ..... 80 01609

[51] Int. Cl.[3] ..... F23N 5/00

[52] U.S. Cl. ..... 431/66; 431/73; 431/86

[58] Field of Search ..... 431/18, 72, 73, 86, 431/153, 66, 67, 69, 70

[56] References Cited

U.S. PATENT DOCUMENTS

| | | | |
|---|---|---|---|
| 1,631,348 | 6/1927 | Terry | 431/73 |
| 1,945,109 | 1/1934 | Fonseca | 431/86 |
| 2,173,465 | 9/1939 | Andler | 431/66 |
| 2,406,185 | 8/1946 | Aubert | 431/73 |
| 2,432,942 | 12/1947 | See et al. | 431/73 |
| 2,507,130 | 5/1950 | Williams | 431/66 |
| 2,596,290 | 5/1952 | Ryder et al. | 431/72 |
| 2,689,000 | 9/1954 | Musat et al. | 431/72 |
| 3,079,984 | 3/1963 | Wright et al. | 431/66 |
| 3,759,654 | 9/1973 | Clifford | 431/66 |
| 4,226,581 | 10/1980 | Schilling | 431/73 |

FOREIGN PATENT DOCUMENTS

| | | | |
|---|---|---|---|
| 557734 | 5/1958 | Canada | 431/72 |
| 55-3506 | 1/1980 | Japan | 431/86 |

*Primary Examiner*—Daniel J. O'Connor
*Attorney, Agent, or Firm*—Young & Thompson

[57] ABSTRACT

Control device for at least one sequential burner of a cooking apparatus, comprising in combination:

a geared-down synchronous motor and a drum which can be driven in rotation by this motor, an electric circuit associated with this drum, comprising at least one electric contact pressing upon the surface of the drum and at least one electrically conductive track arranged on the drum in such manner as to permit operation of the burner according to heating sequences which are variable as a function of the position of the electric contact on the drum, and means for adjusting the position of the contact in relation to the conductive track in order that the duration of the heating sequences of the burner may be varied progressively and continuously.

11 Claims, 8 Drawing Figures

DEVICE FOR THE CONTROL OF A SEQUENTIAL BURNER OF A COOKING APPARATUS

BACKGROUND OF THE INVENTION

Figure 1:
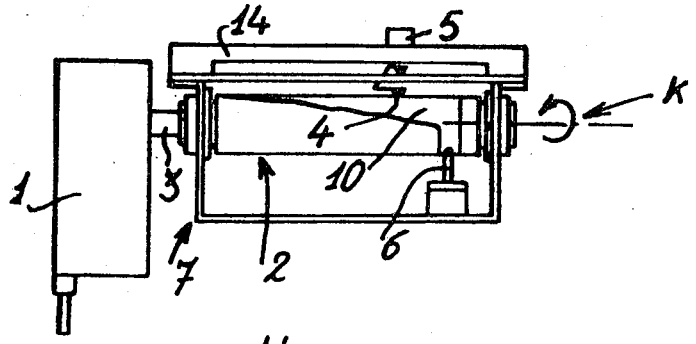

The present invention has for object a device for the control of a sequential burner of a cooking apparatus.

In cooking equipment it is known to produce burners called "sequential," that is to say functioning intermittently or in sequences. Such a type of operation permits of metering the consumed heating energy by regulating a predetermined time of feed of the burner, for a given cooking operation. Thus the ratio of the time of operation or feeding to the total time of the cycle expresses the metering of the energy as a percentage.

To facilitate the use of a burner equipped with a control device of this kind it must be possible to mark up fixed sequences between a minimum and a maximum, and to permit intermediate adjustments. Hitherto the known control devices are of three types:

programmer device
energy metering device
electronic device.

By reason of their bulk, programmers permit of realising only a certain number of fixed sequences, without possibility of intermediate adjustments.

The energy metering devices currently called "infinites" are realised in such manner as periodically to eliminate the electric feed of a resistor in such manner that the ratio of the operating time to the total cycle time is identical for all cycles, for a specific position of the adjusting knob. The driving element of an "infinite" is a bimetallic strip heated by a resistor connected after the contact; when the elastic force of the bimetallic strip deformed by the rise in temperature becomes greater than the attraction force of a magnet, the contact opens sharply, and the same applies on re-engagement. The metering variation is obtained by means of a cam fixing the initial position of the bimetallic strip.

Such an energy metering device permits of effecting a continuous adjustment of the energy supply, by variation of the angular position of the cam, it thus being possible to obtain fixed sequences and intermediate adjustments at the choice of the user. Unfortunately it has been observed that these sequences are subject to undesirable variations, and it has been determined that these variations derived from the following reasons: the variation of the tension of the supply mains, the variations of the heating resister of the thermal switch when the metering device is manufactured on a large scale, and the variation of the force of the permanent magnet associated with the thermal switch.

Under these circumstances the object is not achieved of obtaining a control device having satisfactory operation and reliability. The electronic device has the drawback of being destroyed if the temperature rises.

The invention has the aim of realising a control device which has only reduced bulk, which permits intermediate adjustments between the fixed sequences and which does not display the drawbacks of the energy metering systems.

To this end and in accordance with the invention the control device of at least one sequential burner of a cooking apparatus comprises a geared-down synchronous motor and a drum which can be driven in rotation by this motor, and the drum co-operates with at least one electric contact pressing upon the surface of the drum and is provided with at least one electrically conductive track formed in such manner as to permit operation of the burner in accordance with heating sequences which are variable as a function of the position of the electric contact upon the drum, means being provided to regulate this position of the contact in relation to the conductive track in order that the duration of the heating sequences of the burner may be varied progressively and continuously.

This device is of only slight bulk in comparison with programmers, and the geared-down synchronous motor is not sensitive to variations in the mains voltage, in contrast to the energy metering device.

According to one particular feature of the invention the electrically conductive track is staged in order to present to the burner feed electric contact a length variable as a function of the position of the contact on the drum.

As the position of the sliding contact is controlled either by a linear slider or by a rotating knob, thus the user can adjust the heating sequence to the desired value by suitably positioning the contact on the track of the drum in order that the burner may be fed only when contact is established between the electric track and the said contact.

According to one form of embodiment of the invention the drum is cylindrical and comprises a conductive track of width increasing preferably practically continuously in the axial direction of the drum, this track terminating in a conductive band extending over the whole circumference of the drum, while an interval is reserved between the narrowest extremity of the track and the corresponding terminal part of the drum, in order to constitute a non-conductive band extending over the whole circumference of the drum.

Thus the user has the facility of displacing the adjustment contact between a zero point where the various elements of the device are electrically disconnected and a non-sequenced operating point, a whole series of intermediate sequences, the durations of which are variable at the choice of the user, being available between these two extreme points.

Thus the invention solves the problem in a particularly simple manner, and no undesirable variation of resistance or of permanent magnet force can intervene in this system.

According to a further characteristic of the invention the control device comprises a system for ignition and feeding of the burner at the commencement of each heating sequence, also a flame presence security device co-operating with the ignition and feed system so as automatically to cut off the gas supply of the burner after a predetermined time if the ignition system should fail to function or should function defectively.

This form of embodiment has the purpose of bringing a positive security to the control device in order to ensure an automatic interruption of the gas feed to the burner after a predetermined duration in different hypothetical cases which will be explained hereinafter.

According to one form of embodiment of the invention the safety device comprises means for keeping open a burner gas feed electric valve in the presence of a flame at the burner for the said predetermined time during which a first contact of the ignition and feed system, controlled by the rotation of the drum, is open.

According to one important characteristic of the invention the ignition and feed system of the burner comprises a cam fixed to the end of the drum which opens the said first contact after the closure of a second contact at the commencement of a heating sequence, and during the said predetermined time, these two contacts being placed on the terminals of the electric valve and of the drum drive motor, and the electric valve and the motor are connected to a third reversing contact of the safety device which, when a flame appears at the burner, comes into a position in which it permits continuity of the electric feed of the motor and of the opening of the electric valve through the duration of opening of the first contact, then the cam recloses this first contact, permitting the drum motor to continue its rotation causing opening of the second contact at the end of the heating sequence, this cycle being repeated automatically when the second contact is closed afresh at the commencement of the following heating sequence.

Thus it is understood that if no flame is detected at the burner by the flame presence security device, the reversing contact of this safety device remains in a second position in which the electric feed of the motor is cut off and the burner gas feed electric valve is closed, as soon as the first contact is opened by the cam fixed to the drum.

Under these conditions the safety system automatically avoids all risk of gas escape as a consequence of a prolonged supply of gas to the burner while the latter is extinguished.

Further particular features and advantages of the invention will appear in the course of the following description. Two forms of embodiment of the invention are represented in the accompanying drawings, given by way of non-limitative examples.

Figure 2:
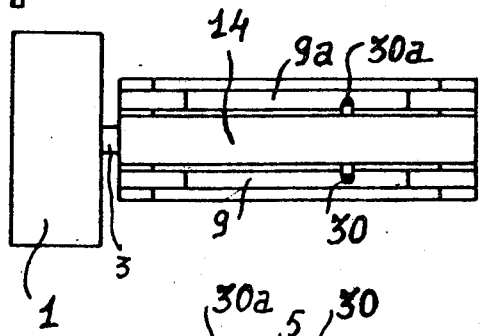
Figure 3:
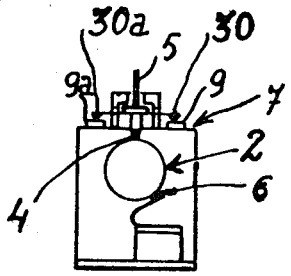
Figure 4:
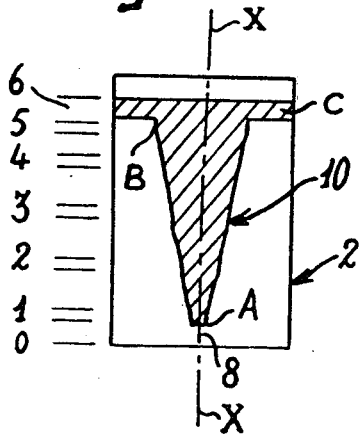
Figure 5:
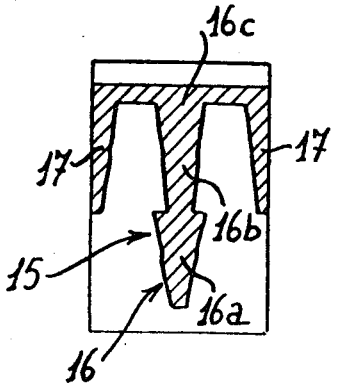
Figure 6:
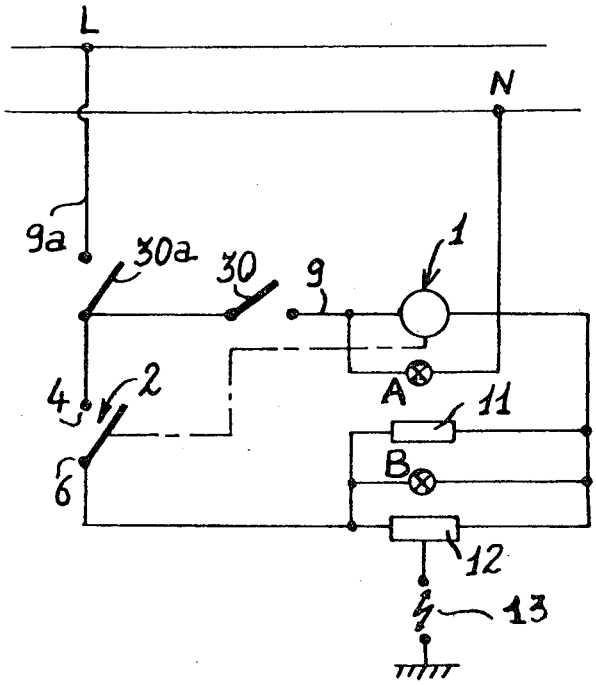
Figure 7:
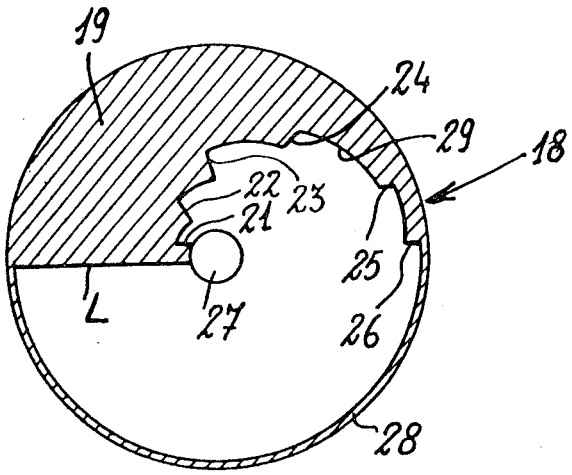
Figure 8:
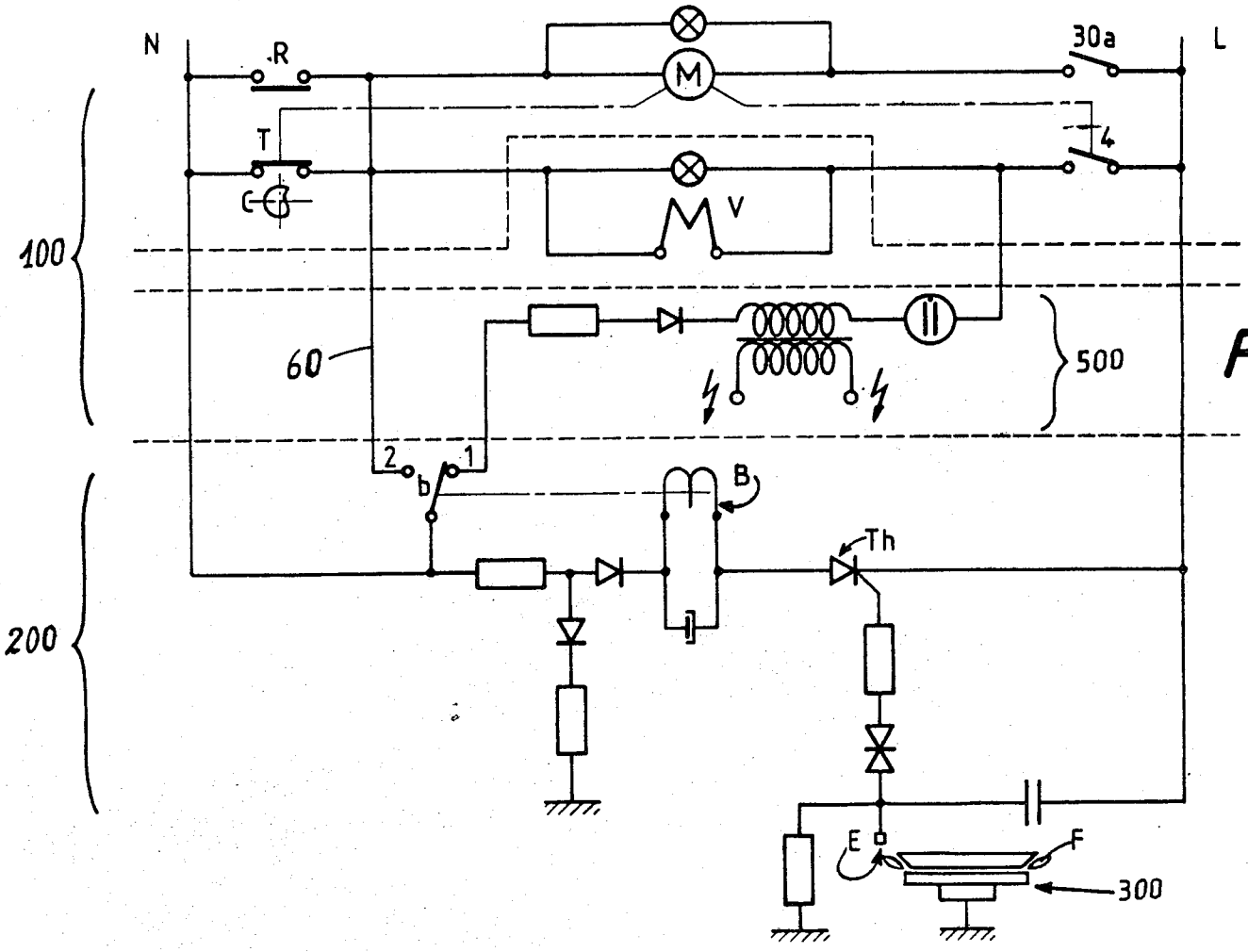

FIG. 1 is a view in longitudinal elevation of a first form of embodiment of the control device for a sequential cooking burner according to the invention, FIG. 2 is a plan view of the device according to FIG. 1, FIG. 3 is an end elevation of the device according to FIGS. 1 and 2, in the direction of the arrow K in FIG. 1, FIG. 4 is a plan view representing the developed surface of the drum with which the control device according to FIGS. 1 to 3 is equipped, FIG. 5 is a view, analogous to FIG. 4, of a variant of embodiment of the drum, FIG. 6 is a diagram of the electric circuit into which the control device according to the invention is to be inserted, FIG. 7 is a plan view of a variant of embodiment of the drum carrying the conductive track, FIG. 8 is an electrical diagram representing a form of embodiment of the burner ignition and feed system, also of the flame presence security device associated with this ignition system.

The device as represented in FIGS. 1 to 3 is intended to effect the controlling of a sequential burner of a cooking apparatus. In accordance with the invention it comprises a geared-down synchronous motor 1 and a cylindrical drum 2 which can be driven in rotation by the output shaft 3 of the motor 1.

The drum 2 is made of a conductive material, for example brass, and co-operates with a central electric contact 4 of a slider 5, the electric current being brought to the drum 2 by this sliding or rubbing contact 4, fed by a track 9*a* and a contact 30*a* connected to a contact 30 which feeds a track 9.

The drum 2 is placed in a support fitting 7. It comprises an electrically conductive track 10 the width of which increases from one end to the other of the drum 2, in order to present, to the contact 4 entrained by the slider 5, a length which is variable as a function of the position of the contact 4 on the drum 2. Thus it is seen that the width of the track 10 increases, preferably in approximately regular manner, in the axial direction of the drum 2 from an end A of minimum width to a zone B of maximum width. The latter is attached to a conductive band C extending over the whole circumference of the drum 2, on which there is placed the rubbing piece 6 feeding the various components. An interval 8 is reserved between the narrower extremity A and the corresponding terminal part of the drum 2. Beyond the continuous conductive band C the drum extends a short distance further.

The interval 8 between the terminal part of the drum 2 and the point A of the conductive zone thus forms a continuous non-conductive band extending over the whole circumference of the drum 2. Thus the width of the conductive track 10 increases regularly from the apex A to the base B, symmetrically on both sides of an axis of symmetry X-X'.

The sliding contact 4 is further connected to two parallel conductive tracks 9 and 9*a* disposed on the two sides of the slider 5 on the support fitting 7 (FIGS. 2 and 3) and beneath the two contacts 30 and 30*a* fast with the slider 5. The conductive track 9*a* receives the current input and the track 9 feeds the geared-down motor 1; the various components are fed by the contact 6 itself associated with this control device, when the contact 4 slides over the conductive track 10.

The constituent elements of the electric circuit associated with this control device are represented diagrammatically in FIG. 6. Here there are seen the contacts 4 and 6, the geared-down synchronous motor 1 to the terminals of which an electric valve 11 for the one part is connected in known manner, and an igniter 12 itself connected to a spark plug 13 of a burner (not shown). The whole of this circuit is connected to the mains feed voltage by wires 14 and 15. Two signals A, B are provided: A, connected to the terminals of the motor 1, signals the sequential operation when the contact 30 is closed on the track 9; B interposed between the electric valve 11 and the igniter 12 permits visual display of the sequence.

The drum 2 can be constituted by a conductive body, for example of brass as indicated above, on the surface of which there has been formed a recess filled with insulator moulded over the surface of the drum, which insulator can for example be bakelite or any suitable insulator. Thus the recess of the drum body in which the insulator is moulded must be realised in accordance with a geometry appropriate to the desired characteristics for the conformation of the conductive track 10.

The operation of this control device is easily understood: the geared-down motor 1 having been started at a suitable rate, for example two revolutions per minute, the cook places the slider 5 for positioning the contact 4 at the desired position along a graduated scale 14 of sequences, according to the desired heating sequence. The duration of this sequence is minimal when the contact 4 is situated in the terminal zone A of the track 10, and it increases regularly as far as the zone B, while the terminal band C permits heating without sequence. Thus this device can be used by the cook like the thermostat of an oven the rate of heating of the burner being modified when desired. The marking of the different positions of the slider 5 is effected on the pre-calibrated scale 14.

By way of indication, in FIG. 4 there are represented six possible positions of the slider 5, numbered from zero to six on the corresponding scale 14, between a zero graduation placed against the non-conductive band, and a graduation 6 placed against the continuous conductive band C. Between these two extremes the cook has a choice among five heating sequences numbered 1–5, of progressively variable duration. Furthermore she can place the slider 5 at any point whatever between two consecutive graduations so as to obtain an intermediate sequence of any duration between the extreme durations determined by the geometrical configuration of the conductive track.

The advantages of the control device according to the invention are as follows:

The bulk of the geared-down synchronous motor 1 and the drum 2 is sufficiently small for this device to be housed in the available space of a domestic cooking apparatus. Moreover the cost price of such a system is relatively low, less than various known devices.

The obtained heating sequences cannot be put out of adjustment by factors such as a variation in resistance or in the force of a magnet, giving full reliability to the adjustment of the device.

The device is insensitive to variations in the feed voltage, thanks to the synchronous motor 1, and it permits the obtaining, according to choice, of a multitude of sequences intermediate between the marked heating sequences, for example according to the graduation 0 to 6 illustrated in FIG. 4. The temperature has no effect upon its operation.

FIG. 5 shows a variant of embodiment of the conductive track 15; this is subdivided into three branches 16, 17 extending coaxially with the drum 2 over unequal lengths. The two branches 17 are identical and extend symmetrically in relation to the central branch 16, which has a length greater than that of the branches 17. The branch 16 comprises a head **16*a* the width of which increases from one extremity to the other, similarly to the track 10. Then after the base of this head 16*a* the width of the branch 16 decreases suddenly, in order to increase again forming an extension 16*b* of maximum width to a terminal part 16*c* forming a continuous conductive band over the whole periphery of the drum. The two branches 17 commence at the level of the base of maximum width of the head 16*a*, their width increasing progressively to the continuous band 16*c***.

The conductive track realised in this way has a width practically equal to that of the track 10, from the extremity of the branch 16 to the continuous band **16*c*, but beyond the base of the head 16*a* the heating sequence is broken into four sub-sequences, namely two heating sub-sequences when the contact 4 is pressed upon the branch 16*b* or one of the lateral branches 17, and two heating interruption sub-sequences when the contact 4 is in one of the insulating zones situated between the middle branch 16*b* and the lateral branches 17**.

In the form of embodiment as illustrated in FIG. 7, the drum has a circular form and is thus in fact constituted by a disc 18 on which the conductive track 19 is arranged with steps referenced 21 to 26 between a central zone 27 and the periphery of the disc. In this example six steps 21–26 are provided, but of course this number can vary.

These steps 21–26 are arranged in radial directions offset from one another about the central zone 27, forming intermediate stages where the radius of curvature varies progressively between the two adjacent steps. Thus the conductive track 19 extends firstly over a width L slightly less than the radius of the disc 18, then this distance decreases at each step 21, 22, etc. until the periphery of the disc 18, on which there is provided a continuous band 28 extending over the whole periphery of the disc.

Thus the sliding contact associated with the disc 18 can travel, according to its position between the central insulating zone 27 and the circumference of the disc, over conductive lengths increasing progressively from the step 21 to the terminal step 26 on the track 19 as it is displaced towards the periphery of the disc. Correspondingly the heating sequences have obviously an increasing duration.

As already indicated, the intermediate stages between two consecutive steps, such for example as the stage 29 extending between the steps 24 and 25, have a curvature increasing towards the periphery of the disc, in order to permit the user intermediate settings for the heating sequences.

In a manner similar to the previous embodiment, the slider controlling the electric contact can be positioned opposite to graduations each corresponding to a step 21, 22, etc.

The form of embodiment of the invention as illustrated in FIG. 8 has the purpose of solving the following problem:

Should the igniter fail to operate or operate defectively while the burner is supplied with gas, the control device is without safety means for then cutting off the gas supply, which constitutes a risk for the safety of the user.

Absence of operation or defective operation of the igniter can occur in one of the following cases: the igniter is out of action as a result of failure of one of its components, the current feed cable to the spark plug connected to the igniter is disconnected, the spark plug is cracked, the spark plug is temporarily insulated as a result of an untimely overflow of foodstuffs on to the burner, etc.

Thus the point is to add positive security to the control device in order to ensure automatic interruption of the feed of gas to the burner after a predetermined duration in the various cases mentioned above.

The control device as illustrated in FIG. 8 comprises, in combination, a system for the ignition and feed of the burner at the commencement of each heating sequence, designated by the general reference 100, and a flame presence security device designated by the general reference 200, co-operating with the ignition and feed system 100 in such manner as to cut off the gas feed of the burner 300 automatically after a predetermined time in the case of absence of operation or defective operation of the ignition system 100 and more precisely of the electronic igniter 500 of this system, preventing the appearance of a flame F at the burner.

The ignition and feed system 100 comprises, as well as the electronic igniter 500 of conventional type known per se, which will not be described in greater detail, a cam C fixed to the end of the drum (not shown) and arranged to open a first contact T after the closure of the second contact 4 corresponding to the contact 4 on the drum in FIGS. 1 and 3. Thus this contact 4 closes when it is on the conductive track and opens when it is on an insulating part.

The cam C keeps the contact T open for a predetermined time, for example 0.5 second. The contacts T and 4 are placed on the terminals of the electric valve V and the drive motor M of the drum. According to an essential particular feature of this embodiment the electric valve V and the motor M are connected, through a connection 60, to a contact-reverser b forming part of the safety device 200. The ignition system further comprises a manual resetting contact R the function of which will be explained hereinafter, also the contact 30*a*.

The safety device 200 comprises an electrode E sensitive to the flame F of the burner 300, connected to a thyristor Th itself connected to a relay B connected to the third contact b. Therefore the presence of a flame F between the mass of the burner 300 and the electrode E makes the thyristor Th conductive, which then actuates the relay B which trips the reversing contact b causing it to pass from the position 1 in which it is represented in the drawing into the position 2.

In the position 1 the contact reverser b connects the safety device 200 to the electronic igniter 500, while in its position 2 the contact b ensures the electric feeding of the electric valve V and the motor M, through the intermediary of the connection 60 which is then connected to the phase N of the mains.

In the absence of flame F, no control current is established on the grid of the thyristor Th which remains non-conductive so that the relay B cannot actuate the contact b, which remains in the position 1. Therefore, if moreover the contact T opens, the feed of the motor M and of the electric valve V is cut off.

The igniter 500 is moreover connected to the electric valve V, itself controlled by the contact 4 placed beside the phase L of the mains, while the contacts T and R are placed on the side of the phase N.

The cam C is arranged in such manner that the time at the end of which it opens the contact T, plus the interval during which the latter remains open, is less than the duration of the shortest heating sequence.

Thus in the case where this minimal sequence is three seconds, the cam C can open the contact T at the end of two seconds and keep it open for 0.5 second, and recloses it for the remainder of the cycle.

Now the operation of this safety circuit will be described firstly in the case where the ignition of the burner is effected before the opening of the contact T, then in the case of accidental non-ignition.

1. Operation of the safety system when ignition takes place before opening of the contact T.

(a) The contact 30*a* is closed, starting the rotation of the motor M.

(b) When the contact 4 arrives on the conductive track of the drum it closes.

Therefore the electric valve V opens, the contact T remaining closed, while the igniter 500 emits sparks (the contact T still remaining closed).

(c) The gas arriving at the burner 300 following the opening of the electric valve V ignites. The conductive property of the flame F ensures the passage of a current over the grid of the thyristor Th, which becomes conductive and thus permits the relay to trip the reversing contact b to its position 2. The connection is then established between the feed mains (phase N), the motor M and the electric valve V, through the intermediary of the contact reverser b and the connection 6.

(d) Two seconds after the closure of the contact 4, the contact T opens for 0.5 second. The contact b, being in the position 2, maintains the electric feed of the motor M which continues its rotation, likewise the feed of the electric valve V which remains open.

At the end of 0.5 second, that is to say 2.5 seconds after the closure of the contact 4, the cam C recloses the contact T which permits the motor M to continue its rotation and consequently to cause opening of the contact 4 at the end of the selected heating sequence, for example after three seconds in the case of the sequence of minimum duration.

A fresh cycle analogous with that just described is repeated when the contact 4 comes afresh on to the conductive part of the drum and closes.

2. Function of the safety system in the case of non-ignition

As already indicated above, it is possible that the electronic igniter 500 may not operate or may operate in a defective manner, insufficient to ignite the gas issuing from the burner 300.

This can occur for example if the igniter 500 has one of its components out of action, or if the current supply cable to the spark plug is disconnected, or if the spark plug is cracked, or if it is still momentarily insulated as a result of an untimely overflow of any liquid or foodstuff from a cooking vessel, etc.

In this case, after closure of the contact 30*a* and of the contact 4, the igniter 500 does not ignite the burner 300. Therefore the thyristor Th does not become conductive and the contact b remains in the position 1.

Two seconds after the closure of the contact 4 the contact T opens, because of the cam C. The contact reverser b having remained in the position 1, the feed of the motor M and of the electric valve V is cut off, so that the motor stops and the electric valve V closes, preventing the passage of the gas towards the burner 300.

Thus all danger of gas leakage is avoided, the gas feed being automatically stopped by the safety device 200 two seconds after the starting up of the motor M and the opening of the electric valve V.

To release the safety system the user must intervene manually by pressing upon the contactor R until the closure of the contact T which will permit the resumption of the cycles.

The invention is not limited to the above-described form of embodiment and can include variants of execution. Thus it is apparent that the cam C can be modified to open the contact T after a variable time, according to the minimum duration of the heating sequence, and equally to vary the duration of opening of T.

Moreover the device can be controlled by means of a rotating knob in place of the linear slider 5.

By way of indication, the drum 2 can have a diameter of the order of one centimeter, a diameter of 9.55 mm. corresponding to a developed length of 30 mm. Under these conditions, if the synchronous motor 1 rotates at 2 revolutions per minute, the electric contact travels one millimeter per second over the drum. The drum 2 can likewise be constituted by an insulating material having a suitable hollowing in which the conductive material is lodged. The slider and the contact 4 can be duplicated so that the device may be capable of feeding two burners.

What is claimed as new is:

1. Control device for at least one sequential burner of a cooking apparatus, characterised in that it comprises in combination:

a geared-down synchronous motor and a drum which can be driven in rotation by this motor, an electric circuit associated with this drum, comprising at least one electric contact pressing upon the surface of the drum and at least one electrically conductive track arranged on the drum in such manner as to permit operation of the burner according to heating sequences which are variable as a function of the position of the electric contact on the drum, and means for adjusting the position of the contact in relation to the conductive track in order that the duration of the heating sequences of the burner may be varied progressively and continuously.

2. Control device according to claim 1, characterised in that the drum is constituted by a disc on which the conductive track is arranged with steps between the centre and the periphery of the disc, in such manner that the track extends radially at first over a distance slightly less than the radius of the disc, then this distance decreases at each step as far as the periphery of the disc, the contact sliding on the surface of the disc thus travelling increasing lengths on the conductive track as it is displaced on the periphery of the disc.

3. Control device according to claim 2, characterised in that between two successive steps or stages the conductive track has a radial width varying in approximately continuous and progressive manner, a conductive band being provided on the whole of the periphery of the disc and an insulating interval being reserved between the centre of the disc and the first step.

4. Control device according to claim 1, characterised in that the electrically conductive track is staged so as to present, to the burner feed electric contact, a length which is variable as a function of the position of the contact on the drum.

5. Control device according to any one of claims 1 to 4, characterised in that the means for regulation of the position of the electric contact on the conductive track are constituted by a linear slider or a rotary knob.

6. Control device according to claim 1, characterised in that the conductive track is subdivided into a plurality of branches extending coaxially with the drum over unequal lengths so as to determine a plurality of alternate heating and interruption sub-sequences, for example three conductive branches, of which two are identical and extend symmetrically in relation to a central branch which has a length greater than that of the lateral branches, these three branches reuniting at one end of the drum to form a continuous conductive band over the whole periphery of the drum.

7. Control device according to claim 1, characterised in that it comprises in combination a system for ignition and feed of the burner at the commencement of each heating sequence, and a flame presence security device co-operating with the ignition and feed system so as automatically to cut off the gas feed of the burner after a predetermined time in the case of non-operation or defective operation of the ignition system.

8. Device according to claim 7, characterised in that the security device comprises means for keeping open, in the presence of a flame at the burner, an electric valve feeding the burner with gas, and for keeping the motor energised when a first contact of the ignition and feed system opens, controlled by the rotation of the drum.

9. Device according to claim 8, characterised in that the ignition and feed system of the burner comprises a cam fixed to the end of the drum which opens the first contact (T) at the end of a preset time interval after the closure of a second contact (4), and during the said predetermined time, these two contacts being placed on the terminals of the electric valve and of the drive motor of the drum, and the electric valve and the motor are connected by a connection (60) to a third contact reverser (b) of the safety device which, when a flame is detected at the burner, comes into a first position in which, through the said connection (60), it ensures the continuity of the electric feed of the motor and of the opening of the electric valve through the duration of opening of the first contact (T), then the cam recloses the first contact (T) so that the drum motor continues its rotation, causing the opening of the second contact (4) at the end of the heating sequency, this cycle being repeated automatically when the second contact (4) is closed afresh at the beginning of the following heating sequence.

10. Device according to claim 9, characterised in that the igniter of the ignition system is connected on the one hand to the electric valve controlling the feed of the burner and on the other to the said third contact reverser (b) in such manner that in the absence of a flame this reverser comes into a second position where it establishes the connection between the igniter and the security device, and disconnects the feed connection of the motor and the electric valve.

11. Device according to claim 9, characterised in that the flame presence security device comprises a flame-sensitive electrode connected to a thyristor itself connected to a relay connected to the third contact (b), in such manner that the presence of a flame between the mass of the burner and the electrode renders the thyristor conductive which then actuates the relay which trips the third contact (b) placing it into the said first position where it ensures the feed of the electric valve and the drum drive motor during the time of opening of the first contact (T), predetermined by the cam.

* * * * *